US011148315B2

(12) United States Patent
Brown et al.

(10) Patent No.: US 11,148,315 B2
(45) Date of Patent: Oct. 19, 2021

(54) SYSTEM AND METHOD FOR INSTALLING AND USING GRAPHICAL DIES

(71) Applicant: METAL MAGIC, INC., Phoenix, AZ (US)

(72) Inventors: Charles Brown, Phoenix, AZ (US); Cy R. Brown, Phoenix, AZ (US)

(73) Assignee: METAL MAGIC, INC., Phoenix, AZ (US)

( * ) Notice: Subject to any disclaimer, the term of this patent is extended or adjusted under 35 U.S.C. 154(b) by 1 day.

(21) Appl. No.: 16/757,406

(22) PCT Filed: Oct. 19, 2018

(86) PCT No.: PCT/US2018/056763
§ 371 (c)(1),
(2) Date: Apr. 19, 2020

(87) PCT Pub. No.: WO2019/079753
PCT Pub. Date: Apr. 25, 2019

(65) Prior Publication Data

US 2021/0187775 A1 Jun. 24, 2021

Related U.S. Application Data

(60) Provisional application No. 62/574,353, filed on Oct. 19, 2017.

(51) Int. Cl.
*B26D 7/26* (2006.01)
*B26F 1/44* (2006.01)
(Continued)

(52) U.S. Cl.
CPC ..... *B26D 7/2614* (2013.01); *B26F 1/40* (2013.01); *B26F 1/44* (2013.01); *B31F 1/07* (2013.01);
(Continued)

(58) Field of Classification Search
CPC ..... B31F 2201/0794; B31F 2201/0702; B26D 2007/2607; B41F 27/04; B41F 16/0066; B44B 5/0057
See application file for complete search history.

(56) References Cited

U.S. PATENT DOCUMENTS 2,283,587 A 5/1942 Steinbach
5,782,156 A * 7/1998 Collins ..... B26D 7/018 101/415.1
(Continued)

FOREIGN PATENT DOCUMENTS

GB 2386585 9/2003

OTHER PUBLICATIONS

UniLock-Up Micro Adjuster Adjustment Procedure Pamphlet; 2013.
(Continued)

*Primary Examiner* — Jennifer Bahls
(74) *Attorney, Agent, or Firm* — Clark Hill PLC

(57) ABSTRACT

A system and method for aligning and installing graphical dies onto an embossing press or foil stamping press is provided. The system includes a number of die support panels having a number of threaded openings disposed in columns and rows in a grid like fashion and identified with x and y axis indicia. The system also includes a number of dies with a number of apertures each identified with a pair of x and y axis indicia. Fasteners and indicia are used to align and attach the dies to the die support panels in a predetermined position. The system preferable further comprises one or more adjusters used to make minute positioning adjustments to the die after it is installed on the panel.

20 Claims, 3 Drawing Sheets

(51) Int. Cl.
*B31F 1/07* (2006.01)
*B41F 16/00* (2006.01)
*B26F 1/40* (2006.01)

(52) U.S. Cl.
CPC ..... *B26D 2007/2607* (2013.01); *B26F 2001/4418* (2013.01); *B31F 2201/0702* (2013.01); *B41F 16/0066* (2013.01)

(56) References Cited

U.S. PATENT DOCUMENTS

| | | | | |
|---|---|---|---|---|
| 6,119,570 | A * | 9/2000 | Okonski | B26D 7/2628 83/100 |
| 7,096,709 | B2 | 8/2006 | Hutchison et al. | |
| 7,628,053 | B2 | 12/2009 | Bermudez, III | |
| 2004/0089129 | A1 | 5/2004 | Toth | |
| 2012/0192733 | A1* | 8/2012 | Angevine | B44B 5/026 101/26 |
| 2016/0311245 | A1 | 10/2016 | Belling et al. | |

OTHER PUBLICATIONS

EHD and EHF Brochure; 2016.
https://web.archive.org/web/20170609065957/https://kluge.biz/foil-stamping/ehd-series-14-x-22/; Jun. 9, 2017 (retrieval date).
Heidelberg(R) Video Stills; Feb. 4, 2013.
Third Party Observation dated Feb. 7, 2020 for PCT/US2018/056763.
International Search Report dated Dec. 20, 2018 for PCT/US2018/056763.

* cited by examiner

SYSTEM AND METHOD FOR INSTALLING AND USING GRAPHICAL DIES

CROSS-REFERENCE TO RELATED APPLICATION

This application claims priority to, and the benefit of, U.S. Provisional Patent Application Ser. No. 62/574,353 filed on Oct. 19, 2017.

FIELD OF THE INVENTION

The present invention relates generally graphical dies for use with embossing or debossing paper stock. More particularly, the present invention relates to an improved system and method for aligning and installing die plates on a press.

BACKGROUND OF THE INVENTION

Embossing has been used in the field of graphical design as a finish for high end printed products for hundreds of years. Embossing is the process by which graphical dies are used to alter the surface of paper stock or other substrates by providing a three-dimensional or raised effect on selected areas. The procedure typically requires the use of two dies: one male die that is generally raised and one female die that is generally recessed. The engraved designs on the male and female dies fit into each other so that when the paper is pressed between them, the raised die forces the stock into the recessed die and creates the embossed impression. A predetermined level of pressure is applied to the dies by the embossing press in order to squeeze the fibers of the paper, which results in a permanently raised area in the paper in the desired design and configuration.

Most types of paper stock of varying weight and thicknesses can be embossed and size is not normally a consideration. Several types of embossing are known and commonly used. For example, embossing without ink, so that the resultant image is raised but not colored, is called "blind embossing." In contrast, embossing used in conjunction with ink, so that the raised area is colored, is called "color register embossing." Finally, combination embossing is the process of embossing and foil stamping the same image. It involves imprinting and aligning foil over an embossed image to create a foil emboss.

"Debossing" is similar to embossing, but recesses the design rather than raising it. Rather than the paper being raised in specific areas, it is indented. The process involves applying pressure to the front side of a substrate and forcing the material down from the surface.

One of the most commonly utilized embossing press is the clamshell press. In operation, two corresponding sections of the press close together under a predetermined pressure sandwiching the paper stock being embossed between the male and female dies (each of which are installed and aligned on opposite sections of the press). This type of machine typically has a small footprint with a lot of pressure. One of the most commonly used clamshell stamping presses is manufactured by Brandtjen & Kluge, LLC.

Another commonly used type of embossing press is known as a roll or rotary press which uses dies mounted on a roller. To affect embossing, paper, either on a roller or in sheets, is fed through and impressions are "rolled" onto the design. Rotary presses tend to operate more quickly than clamshell presses, but typically the dies are more expensive and with longer set up times. As such, rotary presses are usually used for embossing projects when the necessary quantities needed to be produced justify the additional initial start-up expenses as compared with clamshell press embossing.

In order to achieve the best possible and desired embossing effect, there are three main factors that need to be controlled during embossing process:

1. Pressure: the intensity of the force of impact by the dies and embossing press on the stock being embossed;
2. Heat: the ability to maintain a consistent and desired temperature level for optimal embossing; and
3. Die considerations, including: selecting the appropriate materials and methods for construction of the dies; determining the appropriate die design depth; and proper die installation and alignment on the embossing press.

Of the key factors above, the present invention is directed to the alignment and installation of the dies in a more efficient and easier to use manner. By way of background, graphical dies are the metal plates that have the impression to be embossed engraved or etched on their surfaces. Dies can also refer to the male counterpart (or counterdie) to the female emboss die. Following is a list of commonly used types of dies:

Single-level die: An embossing or debossing die that changes the surface of the paper at one level. This is both the most common and among the least expensive to manufacture of all dies. Single level dies are made usually from magnesium or copper. A magnesium die can be half the price of copper, but can usually only be used for up to about 10,000 impressions before quality degrades. Moreover, a magnesium die can be destroyed with a single misfeed in the stamping machine. Copper dies are stronger than magnesium and will last for far more impressions.

Multilevel die: A die with a number of distinctive levels. It can be engraved by machine and does not require hand-tooling. Multilevel dies are often made of brass. An example of a multilevel emboss is designs that have a "texture" in the background.

Bevel-edge die: Similar to a single level die, but with a precise bevel on the image edge, usually between 30 and 60 degrees. The broader the angle, the greater the illusion of depth. Very deep dies must have beveled edges to prevent cutting through the paper.

Chisel die: An embossing or debossing die with a V-shape, using two bevels without a flat bottom surface. It is most frequently used in debossing. It is also sometimes referred to as a "roof" die.

Textured die: An embossing die with an etched texture which is essentially a single level emboss die with very detailed artwork. These work best for artwork that do not depend on extremely high level of detail to look refined. Organic patterns, skin textures, and other single level textures are typically achieved with a textured die.

Rounded die (domed die): An embossing die that imparts a rounded configuration to an embossed image. It is commonly used for logos and typographical effects.

Sculptured die: A hand-tooled die, usually made of brass, which embosses many levels through the use of curves, angles, and varying depths. These dies are among the most expensive as they require someone to hand sculpt the die based on image references provided (these images usually being transferred to the metal through a photo-etching acid bath for use as a template). They also achieve an appealing effect that some say looks like a bas-relief in paper.

Combination die (foil emboss die): More commonly referred to as a "combo die"—this type of die allows embossing and foil stamping to be accomplished in a single impression. From a design perspective, this means that every part of the design that is being embossed is also being foiled.

As mentioned above, different types of dies are made with different metals. The three most common are magnesium, copper, and brass.

Magnesium is typically used only for single-level dies. Magnesium is a soft metal and is etched using acid. The process is quite fast, with the etching itself taking only a few minutes. The advantage of magnesium is the cost. It is typically about half the cost of copper and about a quarter the cost of brass. The disadvantage with magnesium is that it is soft. A magnesium die will frequently degrade before 10,000 impressions. Also, as mentioned previously, a single jam in a stamping press may permanently ruin a magnesium die.

Copper is also used most commonly for single-level dies. The advantage it has over magnesium is the fact that it is significantly harder, often rated for up to at least 100,000 impressions. Also, typically copper dies are not rendered useless by a jam in the stamping press. While more expensive than magnesium, it is still significantly cheaper than brass. The disadvantage with copper, like magnesium, is that because it is created using an etching process, it is most readily only usable for a single level emboss.

Brass dies are typically best adapted for use as multi-level and sculpted dies. Brass dies are typically manufactured with CNC machining and are required for multi-level and sculpted dies as well as combination foil-emboss dies. Depending on the complexity and detailing of the design, brass dies can be up to two or three times more expensive than copper dies.

Despite advances made over the years with installing and aligning graphical dies onto an embossing press, it still is frequently a time consuming and exacting process that has undesirable amounts of down time when dies are being switched out, repaired, aligned, and prepared for use. As such, there is a need for an improved alignment and installation system and method for installing and readying graphical dies for usage in an embossing press.

Prior art methodologies for installing and aligning dies into proper register have been used for years with very little modifications over time. Typically, most embossing presses employ chases with a number of apertures or holes thereon upon which the dies are selectively attached. Traditionally, "toggle" type connectors, such as those manufactured by Sterling Toggle, Inc. have been employed to selectively attach the dies onto the chases. Initially, dies and counter dies are placed in substantially aligned position by an experienced embossing press operator. Initially, a layover sheet of clear plastic may be used to facilitate initial alignment. Trial and error typically is then employed after the dies are in initial position and samples are made to ensure and to optimize proper alignment and registration.

One prior art device and system that sought to improve upon the prior art systems die installation systems is shown and described in U.S. Pat. No. 7,096,709, directed to a graphic arts die and support plate assembly ("the '709 patent").

Specifically, the '709 patent discloses generally a partially preassembled die carrier plate with die fasteners preinstalled thereon for mounting of die plates thereon. Die plates may also be prealigned and fastened to the die carrier. The die carrier plate itself is adapted to be installed as a unit onto the aperture chase of a flatbed graphic arts embossing press upon delivery. The device of the '709 patent arguably minimizes in-plant set up time in that a significant amount of die installation and alignment is done prior to shipment to end-users. However, it should be appreciated that although less alignment and set up time may be required at the customer end as compared with prior art systems, a good deal of the alignment work still needs to be done at the manufacturer's end and, as a result, more burden and associated cost is simply shifted to the manufacturer rather than being eliminated altogether. Further, the '709 device still requires the ability to fine tune and movably adjust the die plates once the carrier plates are installed on the embossing press which, depending on how much adjustment is necessary, still would require an end users, especially less experienced users, to spend significant additional time adjusting and aligning the dies into proper register and final position.

Accordingly, it is clear that there exists a need for a die alignment system that removes some of the alignment and installation burden from the end user and press operators. Specifically, there exists a need for a die alignment system that requires less time and operator experience for a press operator to correctly align and install the dies upon the embossing press. Further, there exists a need for such a die and alignment system that further minimizes set up time by requiring very little or no fine adjustment after initial installation to bring the dies into proper final register for a given print run.

ELEMENT LIST

10 die
12 design
14 recessed region of die
16 aperture for receiving positioning screw
18 recessed countersunk region
20 through-hole for receiving thumb screw
22 pair of x and y axis positioning indicia
23 die side
24 thumb screw/connector
26 knurled head of thumb screw
28 shoulder of thumb screw
30 threaded region of thumb screw
32 positioning fastener/screw
34 recess for receiving Allen wrench
36 threaded region of positioning screw
38 y-axis indicia
40 x-axis indicia
42 die support panel
44 threaded openings of die support panel
46 gridlines
50 adjuster
52 body
54 apertures
56 adjuster surface
58 adjusting bolt
60 first end (of adjusting bolt)
62 second end (of adjusting bolt)
64 aperture (of adjusting bolt)
66 recess (of adjusting bolt)

SUMMARY OF THE INVENTION

A preferred embodiment of the present invention comprises:

A die system comprising:

a) one or more die support panels, each of said one or more die support panels comprising a plurality of openings disposed substantially equidistantly in a substantially grid like pattern in a plurality of rows and columns, each one said one or more die support panels having a plurality of y-axis indicia, each one of said plurality of y-axis indicia being disposed substantially adjacently with a corresponding row of said openings, each one said one or more die support panels further having a plurality of x-axis indicia, each one of said plurality of x-axis indicia being disposed substantially adjacently with a corresponding column of said openings, wherein each pair of one of said x-axis indicia and one of said y-axis indicia reference and correspond to one of said plurality of openings;

b) one or more dies, each of said one or more dies comprising a top surface having a graphic design thereon and a recessed region surrounding said graphic design, each die further having one or more apertures disposed in said recessed region, each aperture being referenced and identified with a pair of one of said plurality of x-axis and one of said plurality of y-axis indicia disposed substantially adjacently thereto; and c) a plurality of positioning fasteners, each one of said plurality of positioning fasteners corresponding with and being adapted to mate with one of said apertures of one of said dies and one of said openings of said die support panel that corresponds with said pair of x-axis and y-axis indicia disposed next to said aperture, wherein said dies may be properly aligned and selectively attached to said die support panel in a predetermined proper location.

An alternative preferred embodiment of the present invention comprises:

a method for aligning and attaching one or more dies to an embossing press, said method comprising the steps of:

a) providing one or more die support panels, each of said one or more die support panels comprising being installed on an embossing press and having a plurality of openings disposed substantially equidistantly in a substantially grid like pattern in a plurality of rows and columns, each one said one or more die support panels having a plurality of y-axis indicia, each one of said plurality of y-axis indicia being disposed substantially adjacently with a corresponding row of said openings, each one said one or more die support panels further having a plurality of x-axis indicia, each one of said plurality of x-axis indicia being disposed substantially adjacently with a corresponding column of said openings, wherein each pair of one of said x-axis indicia and one of said y-axis indicia reference and correspond to one of said plurality of openings;

b) providing one or more dies, each of said one or more dies comprising a top surface having a graphic design thereon and a recessed region surrounding said graphic design, each die further having one or more apertures disposed in said recessed region, each aperture being referenced and identified with a pair of one of said plurality of x-axis and one of said plurality of y-axis indicia disposed substantially adjacently thereto;

c) providing a plurality of positioning fasteners;

d) using the pairs of x-axis and y-axis indicia disposed next to each aperture of said dies to align said apertures above corresponding openings of said die support panel that correspond with said pairs of x-axis and y-axis indicia disposed next to said apertures;

e) selectively attaching said dies to said die support panel with said plurality of fasteners.

DETAILED DESCRIPTION OF THE INVENTION

With reference to the figures and elements referenced therein, an improved system and method for aligning and installing graphical dies is provided. It should be appreciated that the embodiments described and shown herein are exemplary in nature only and that various additional embodiments are contemplated and within the scope of the present invention. For example, although the embodiments shown and described herein are directed towards a traditional flat embossing press, it should be appreciated that the present invention is readily adaptable for use with other press configurations, such as a rotary press. Additionally, although certain types of graphical dies may be shown and described herein for illustrative purposes, it should be appreciated that the system and method of the present invention is applicable no matter the type of graphical dies being used (i.e. embossing dies, debossing dies, foil stamping dies, etc.) With specific reference to FIGS. 3-4, the die system of the present invention comprises one or more die support panels 42. As can be seen in the Figs., each die support panel 42 further comprises a plurality of preferably threaded openings 44. According to an important aspect of the present invention, the openings 44 are preferably disposed substantially equidistantly in a grid like pattern and as best shown in FIGS. 3 and 4.

Figure 1:
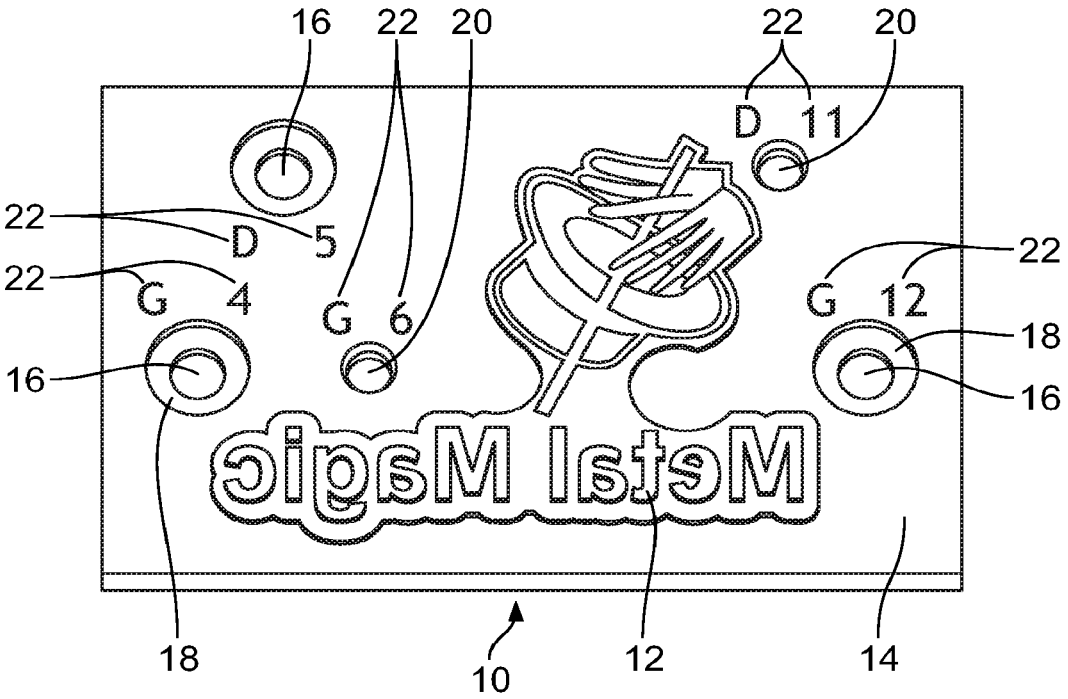
FIG. 1 depicts a die adapted for use with a die alignment system provided in accordance with a preferred embodiment of the present invention.

FIG. 1 depicts a die 10 provided in accordance with a preferred embodiment of the present invention, as will be described more fully below.

Figure 2:
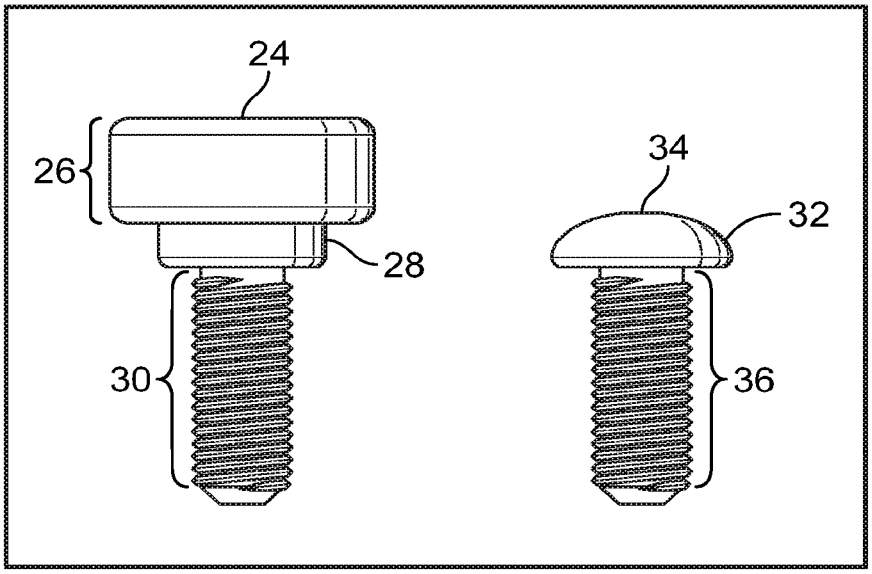
FIG. 2 depicts an exemplary thumb screw and an exemplary positioning screw for attaching a die to a die support plate provided in accordance with a preferred embodiment of the present invention.

FIG. 2 depicts a thumb screw/connector 24 and a positioning fastener/screw 32, both provided in accordance with a preferred embodiment of the present invention, as will be described more fully below.

Figure 3:
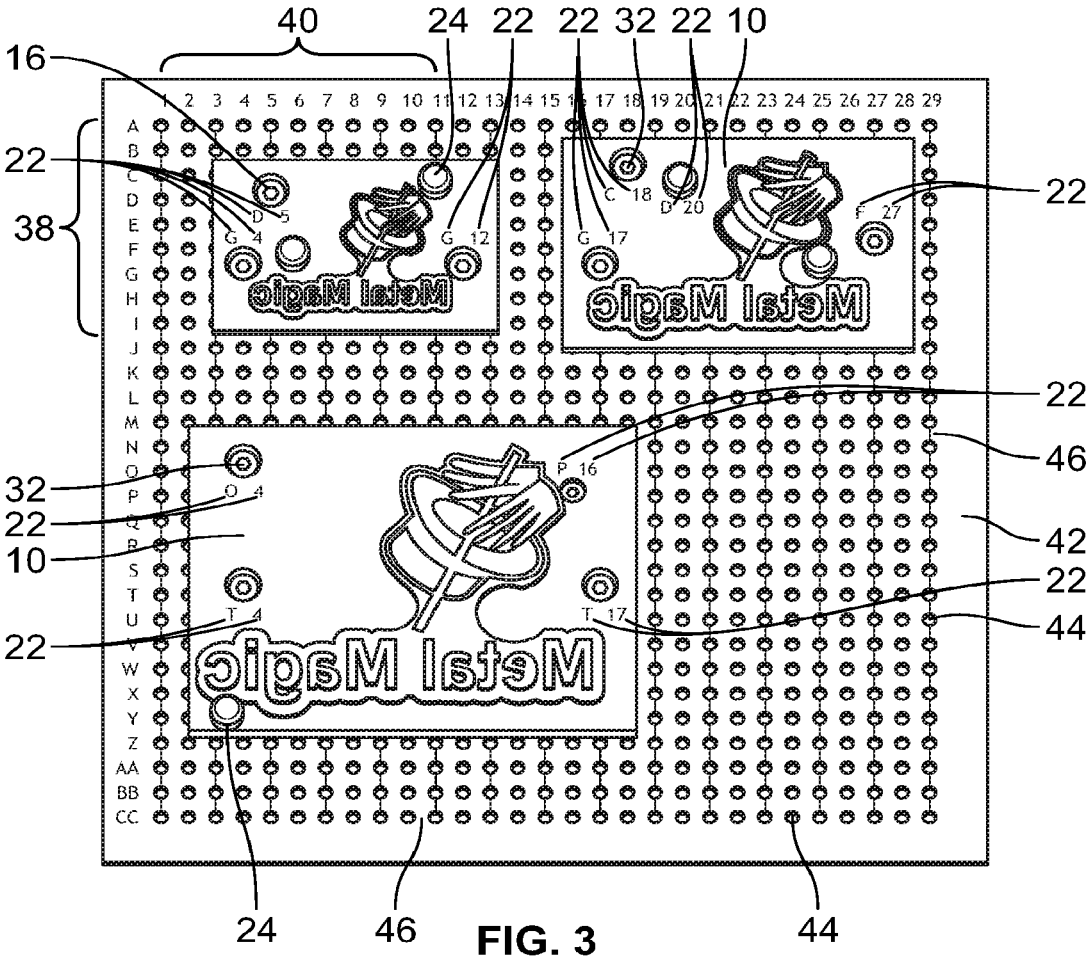
FIG. 3 depicts a die support plate having a plurality of dies aligned and mounted thereon provided in accordance with a preferred embodiment of the present invention.
Figure 4:
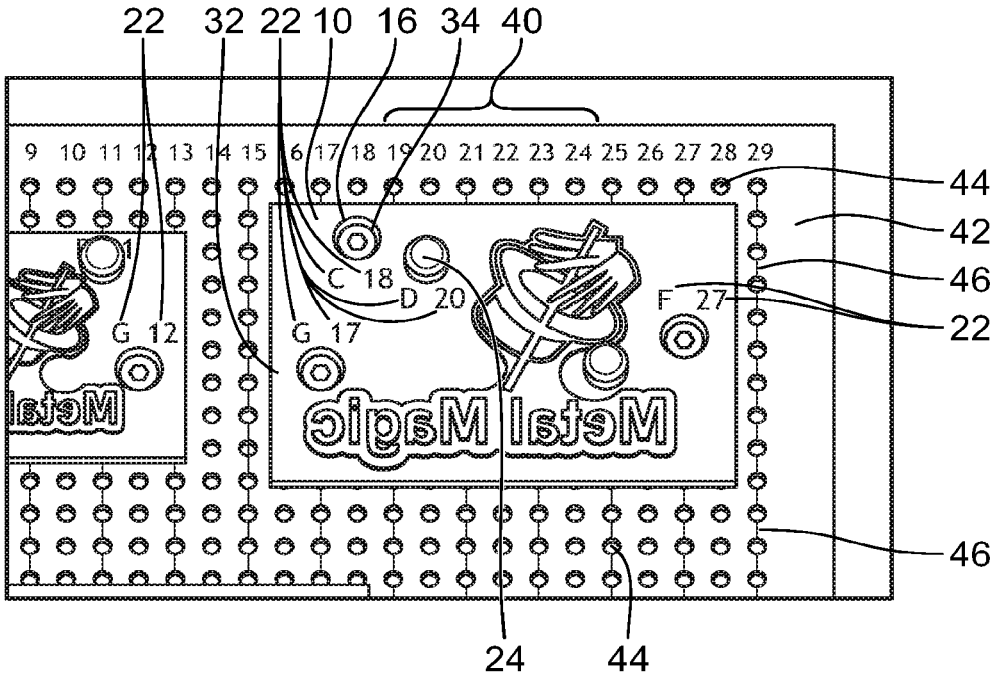
FIG. 4 depicts in close-up a portion of the die support plate of FIG. 3.

With specific reference to FIGS. 3-4, the die system of the present invention comprises one or more die support panels 42. As can be seen in the Figs., each die support panel 42 further comprises a plurality of preferably threaded openings 44. According to an important aspect of the present invention, the openings 44 are preferably disposed substantially equidistantly in a grid like pattern and as best shown in FIGS. 3 and 4.

Preferably, each die support panel 42 is comprised of any suitably durable metal or metal alloy. More preferably, the die support panels are comprised of steel or aluminum. The die support panels may be of any suitable dimensions depending on the dimensions of the press being utilized.

More specifically, the openings 44 are preferably organized substantially uniformly into a plurality of rows and columns and aligned openings 44. More preferably, as best shown in FIGS. 3-4, there is provided on the top surface of the die support panels a plurality of x-axis indicia 40 each of which serves to identify a particular column of the openings 44. Preferably the x-axis indicia 40 are alphanumeric though this is not necessary. Preferably, and as seen in FIGS. 3-4, the x-axis indicia comprise a plurality of sequential numbers and are each etched above a corresponding column of openings.

Similarly, and as best shown in FIG. 3, there is also provided on the top surface of the die support panels a plurality of y-axis indicia 38 each of which serves to identify a particular row of the openings 44. Preferably, the y-axis indicia are also alphanumeric though this is not necessary. More preferably, the y-axis indicia comprise a plurality of letters (single letter and then double letters when there are more than 26 rows on the die support panel 42) and are each etched to the left of a corresponding row of openings. It should be appreciated that the x-axis indicia 40 and y-axis indicia may be etched in alternate locations that sufficiently identify the associated rows and columns.

The significance of which will be detailed later, it should be appreciated that the arrangement of rows and columns of openings 44 (wherein the various rows and columns are each respectively associated with a y-axis indicia 38 and an x-axis indicia 40) result in a situation wherein each opening 44 may be uniquely identified with a pair of x-axis indicia 40 and y-axis indicia 38. For example, the uppermost and leftmost opening in FIG. 3 may be identified by the y-axis indicia "A" together with the x-axis indicia "1"—i.e. (A,1).

Preferably, and as best seen in FIGS. 3-4, the die support panels 42 are also provided with a plurality of etched gridlines 46 that are etched in such a manner that they "link" the various columns and rows of openings 44. The gridlines 46 advantageously assist an observer with identifying which particular opening is being referenced by a given pair of x-axis indicia 40 and y-axis indicia 38. As mentioned previously, the openings 44 are also preferably at least partially threaded.

As best shown in FIGS. 1, 3-4, the die system of the present invention comprises and contemplates the incorporation of one or more dies 10. Preferably, each die 10 has a top surface upon which a raised graphic design 12 has been etched thereon in any one of the etching processes as is known in the art. The top surface of the die 10 also comprises a recessed region 14 that substantially surrounds the area of the graphic design 12.

The dies 10 preferably comprise one or more apertures 16 disposed in the recessed region 14 of the die 10. As can best be seen in FIGS. 1 and 4, each aperture 16 is preferably identified with a pair 22 of one of said plurality of x-axis indicia 40 and y-axis indicia 38. Preferably, each such identifying pair of x-axis and y-axis indicia are etched substantially adjacently with a corresponding aperture. For example, and with reference to FIG. 1, the uppermost and leftmost aperture 16 is identified by the x-axis and y-axis pair 22 of indicia "D 5". Similarly, the lowermost and leftmost aperture 16 in FIG. 1 is identified by the x-axis and y-axis pair 22 of indicia "G 4".

As can be seen in FIGS. 1, 3-4, each aperture 16 preferably is substantially centered within a recessed countersunk region 18 having a larger diameter than the corresponding aperture 16. The apertures 16 are preferably not threaded but it is contemplated that they could also be threaded with threads of the same dimensions as the threads in the openings 44 of the die support panels 42.

As best shown in FIGS. 1, 3-4, each die 10 further preferably comprises one or more through-holes 20. Preferably each through-hole 20 is disposed in the recessed region 14 of the die 10. The through-holes 20 are preferably not threaded but it is contemplated that they could also be threaded with threads of the same dimensions as the threads in the openings 44 of the die support panels 42. If a die comprises through-holes 20, it is preferable that the die 10 comprises fewer through-holes 20 than it has countersunk apertures 16.

As can best be seen in FIGS. 1 and 4, each through-hole 20 is preferably identified with a pair 22 of one of said plurality of x-axis indicia 40 and y-axis indicia 38. Preferably, each such identifying pair 22 of x-axis and y-axis indicia are etched substantially adjacently with a corresponding through-hole 20. For example, and with reference to FIG. 1, the uppermost and rightmost through-hole 20 is identified by the x-axis and y-axis pair 22 of indicia "D 11". Similarly, the lowermost and leftmost through-hole 20 in FIG. 1 is identified by the x-axis and y-axis pair 22 of indicia "G 6".

As can best be seen in FIGS. 1-4, and particularly in FIG. 2, the die system of the present invention further comprises a plurality of positioning fasteners 32. Preferably, each positioning fastener 32 comprises a screw. Each positioning fastener 32 preferably comprises a threaded region 36 that corresponds with and is adapted to mate and is configured to be fixedly received in the threaded openings 44 of the die support panels 42.

Preferably, the head of each positioning fastener 32 comprises a height or thickness that is equal to or less than the depth of the recessed countersunk regions 18 of the apertures 16. More preferably, the positioning fasteners 32 comprise Allen screws that each have a head having a recess 34 for receiving an Allen wrench.

As also shown in FIG. 2, the die system of the present invention also preferably includes one or more connectors 24. Preferably, each of said connectors 24 comprises a threaded thumb screw. Each connector 24 preferably comprises a threaded region 30 that corresponds with and is adapted to mate and is configured to be fixedly received in the threaded openings 44 of the die support panels 42. Each connector preferably further comprises a knurled head 26 with a downwardly extending annular shoulder 28.

Figure 5:
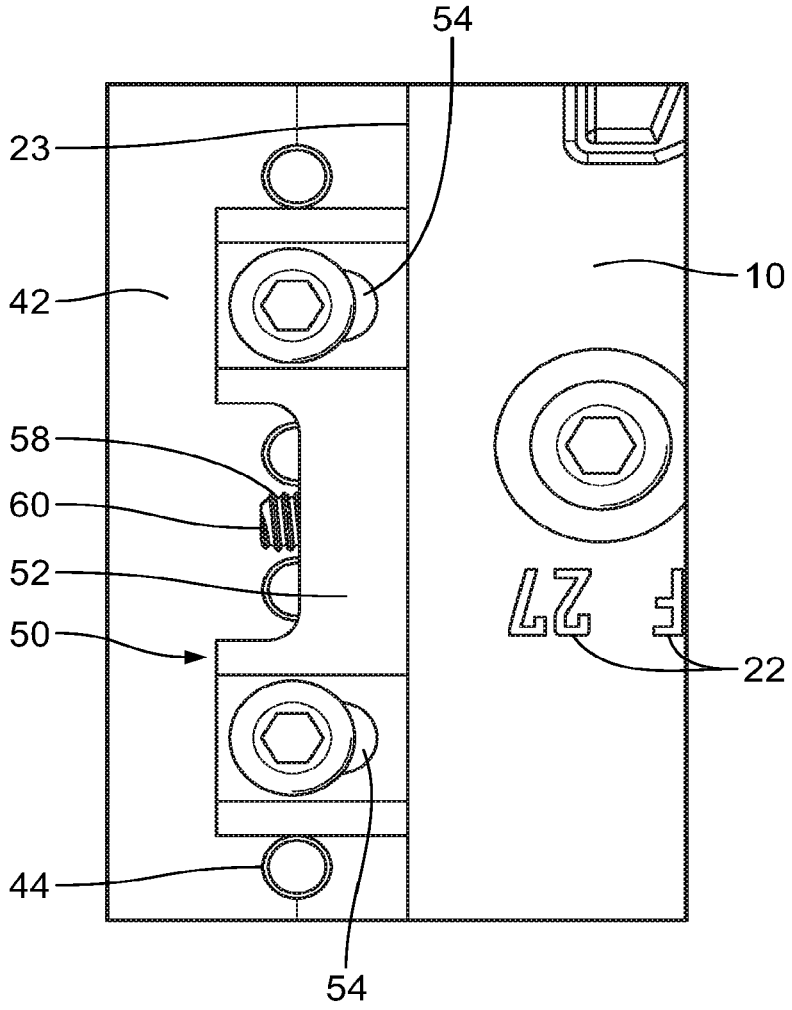
FIG. 5 depicts an adjuster provided in accordance with a preferred embodiment of the present invention.
Figure 6:
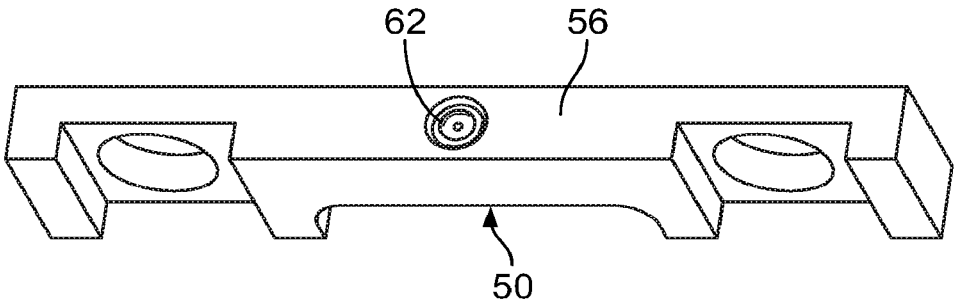
FIG. 6 depicts an alternative view of the adjuster provided in accordance with a preferred embodiment of the present invention.

As shown in FIGS. 5 and 6, an adjuster 50 comprises a body 52, one or more apertures 54, adjuster surface 56, and an adjusting bolt 58. In a preferred embodiment of the present invention, one or more adjusters 50 may be connected to the die support panel 42, and preferably including one at each die side 23 thereof. As shown in FIG. 5, the body 52 defines to one or more apertures 54, the one or more apertures 54 being configured to complementarily align with one more die support panel openings 44. One or more fasteners 32 may pass through the aligned apertures 54 and openings 44 to fasten the adjuster 50 to the panel 42. Upon installation of the adjuster 50, surface 56 will be preferably adjacent to and approximately flush with side 23. The adjusting bolt 58 comprises first and second ends 60, 62, respectively, and it is preferably threaded and configured to pass through a complimentary threaded aperture 64 defined by the body 52. First end 60 comprises a recess 66 for receiving an Allen wrench, whereby the adjusting bolt 58 may be turned through the aperture 64 such that the second end 62 contacts the die side 23.

Now that the various components and features of the die system of the present invention have been shown and described, it will now be described how the various components of the system operate together in such a way as to more effectively align and efficiently install dies into proper register on an embossing press.

First, one or more of the above-described die support panels 42 are provided. Preferably, the die support panels are adapted to be installed or preinstalled on a corresponding press in much the same manner as prior art "honeycomb" chase components were installed on a press.

Next, one or more of the above-described dies 10 are provided for installation on the die support panels 42. The positioning fasteners 32—preferably threaded Allen screws as described previously—are next used to attach the dies 10 onto the die support panels 42 in a predetermined location thereon.

Specifically, and with reference to FIGS. 3 and 4, it will now be described how the dies are positioned and fixedly attached to the die support panels 42. As described previously, each aperture 16 is identified with a pair 22 of x-axis indicia 40 and y-axis indicia 38. As an example and as shown in FIGS. 3 and 4, the die 10 disposed in the top right area of the die support panel 42 includes 3 apertures 16. The apertures in this example are identified with the pairs 22 of x-axis indicia 40 and y-axis indicia 38 as follows: (C 18), (F 27), and (G 17).

An installer would use these pairs 22 of indicia next to the apertures 16 to align and place the die in the proper predetermined location atop the die support panel 42. Specifically, the x-axis indicia 40 of the die support panel, y-axis indicia 38 of the die support panel, die support panel gridlines 46, and given pairs 22 of indicia provided next to the apertures 16 on a particular die are used to place the die in the proper position. In the example described above, a user would note the pairs 22 of indicia [(C 18), (F 27), and (G 17)] and place the die atop the die support panel 42 in such a position that the apertures 16 of the die are aligned with and above the die support panel openings 44 identified by the pairs 22 of indicia associated with each aperture 16.

Again, the die support panel openings 44 are preferably threaded but the apertures 16 of the dies 10 need not be threaded. Once the dies are properly aligned atop the die support panel 42, the positioning fasteners 32, preferably though not necessarily threaded Allen screws, are used to fixedly attach the die in the predetermined location. Specifically, once the die is properly aligned, each fastener is slid downwardly through a corresponding aperture 16 and threaded opening 44 and screwed into position.

In order to facilitate an even more accurate and user-friendly alignment and installation process, and as described previously, the system of the present invention may further include dies having a number of through-holes 20 for receiving connectors such as thumb screws 24. Specifically, and preferably before the dies 10 are fixedly attached to the die support panels 20 as described above, the dies 10 may be initially prepositioned and temporarily affixed to the die support panels 42.

For example, and as shown in FIGS. 3-4, and as described previously, each through-hole 20 is identified with a pair 22 of x-axis indicia 40 and y-axis indicia 38. As an example and as shown in FIGS. 3 and 4, the die 10 disposed in the top right area of the die support panel 42 includes 2 through-holes 20. The through-holes 20 in this example are identified with the pairs 22 of x-axis indicia 40 and y-axis indicia 38 as follows: (D 20) and (G 25).

An installer would use these pairs 22 of indicia next to the through-holes 20 to initially align and temporarily place the die 10 in the proper predetermined location atop the die support panel 42. Specifically, the x-axis indicia 40 of the die support panel, y-axis indicia 38 of the die support panel, die support panel gridlines 46, and given pairs 22 of indicia provided next to the through-holes 20 on a particular die are used to place the die in the proper position. In the example described above, a user would note the pairs 22 of indicia [(D 20) and (G 25)] and place the die atop the die support panel 42 in such a position that the through-holes 20 of the die are aligned with and above the die support panel openings 44 identified by the pairs 22 of indicia associated with each through-hole 20.

Again, the die support panel openings 44 are preferably threaded but the through-holes 20 of the dies 10 need not be threaded. Once the dies are properly initially aligned atop the die support panel 42, the connectors 24, preferably thumb screws, are used to temporarily align and attach the die in the predetermined location. Specifically, once the die is properly aligned, each connector or thumb screw is slid downwardly through a corresponding through-hole 20 and threaded opening 44 and screwed into position.

Upon using the thumb screws 24 and through-holes 20 to initially position and align the die 10 atop the die support panel 42, the dies 10 may be fixedly attached and installed onto the die support panels 42 as described above with the Allen screws 32 and apertures 16, etc. Once the dies 10 are fixedly attached, the thumb screws 24 may be removed prior to press operation. Advantageously, the use of these pre-positioning thumb screws 24 for initial alignment result in a more accurate final installation.

One more adjusters 50 may be provided to execute minor positioning adjustments to the die 10 once it has been installed on the die support panel 42. For example, in a preferred embodiment of the present invention, one or more adjusters 50 are provided at each die side 23. Upon installation of the adjusters 50, the adjusting bolt 58 is preferably rotated through body 52 of the adjuster 50 until second end 62 contacts the die side 23. Thereby, minute adjustments to the positioning of the die 10 may be made at each side 23 as desired to provide an exceptionally precise orientation of the die 10 on the panel 42. Once the die 10 is adjusted, the adjusters 50 may be optionally removed from the panel 42 prior to deployment of the die 10 in an embossing process or a foil stamping process.

While the invention has been represented in detail and described with reference to the drawings and description, this should be regarded as exemplary only and the invention is not limited to the embodiments described and different variants are possible.

The invention claimed is:

1. A die system comprising:

a) one or more die support panels, each of said one or more die support panels comprising a plurality of openings disposed substantially equidistantly in a substantially grid like pattern in a plurality of rows and columns, each one said one or more die support panels having a plurality of y-axis indicia, each one of said plurality of y-axis indicia being disposed substantially adjacently with a corresponding row of said openings, each one said one or more die support panels further having a plurality of x-axis indicia, each one of said plurality of x-axis indicia being disposed substantially adjacently with a corresponding column of said openings, wherein each pair of one of said x-axis indicia and one of said y-axis indicia reference and correspond to one of said plurality of openings;

b) one or more dies, each of said one or more dies comprising a top surface having a graphic design thereon and a recessed region surrounding said graphic design, each die further having one or more apertures disposed in said recessed region, each aperture being referenced and identified with a pair of one of said plurality of x-axis and one of said plurality of y-axis indicia disposed substantially adjacently thereto; and c) a plurality of positioning fasteners, each one of said plurality of positioning fasteners corresponding with and being adapted to mate with one of said apertures of one of said dies and one of said openings of said die support panel that corresponds with said pair of x-axis and y-axis indicia disposed next to said aperture, wherein said dies may be properly aligned and selectively attached to said die support panel in a predetermined proper location.

2. The die system of claim 1, wherein said one or more dies further comprise one or more through-holes, each through-hole being referenced and identified with a pair of one of said plurality of x-axis and one of said plurality of y-axis indicia disposed substantially adjacently thereto.

3. The die system of claim 2, wherein said system further comprises one or more connectors, each of said connectors corresponding with and being adapted to mate with one of said through-holes of one of said dies and one of said openings of said die support panel that corresponds with said pair of x-axis and y-axis indicia disposed next to said through-hole, wherein said dies may be properly aligned and selectively attached to said die support panel in a predetermined proper location.

4. The die system of claim 3, wherein said one or more connectors comprise one or more thumb screws.

5. The die system of claim 4, wherein each of said die has fewer through-holes than apertures.

6. The die system of claim 5, wherein said thumb screws further comprise a knurled head with a downwardly extending annular shoulder.

7. The die system of claim 6, wherein said through-holes are disposed in the recessed region of said one or more dies.

8. The die system of claim 1, wherein each of said one or more apertures further comprises a recessed countersunk region.

9. The die system of claim 8, wherein each of said plurality of positioning fasteners comprises a screw.

10. The die system of claim 9, wherein each of said screws comprises a head having a height that is less than the depth of the recessed countersunk regions of said apertures.

11. The die system of claim 10, wherein said screws are Allen screws each having an opening thereon for selectively receiving an Allen wrench.

12. The die system of claim 9, wherein said x-axis indicia are alphanumeric.

13. The die system of claim 12, wherein said y-axis indicia are alphanumeric.

14. The die system of claim 1, wherein said die support panel further comprises a plurality of etched gridlines, each of said gridlines corresponding with one of said y-axis indicia or one of said x-axis indicia.

15. The die system of claim 1, further comprising one or more adjusters selectively attached to the die support panel and positioned adjacent to a side of the die, wherein the one or more adjusters are configured to optionally contact the side of the die.

16. The die system of claim 15, wherein the die further comprises a plurality of sides, wherein at least one of the adjusters is positioned adjacent to each of the plurality of sides of the die, respectively, and wherein each of the adjusters is configured to optionally contact one side of the die.

17. A method for aligning and attaching one or more dies to an embossing or foil stamping press, said method comprising the steps of:

a) providing one or more die support panels, each of said one or more die support panels comprising being installed on an embossing press or a foil stamping press and having a plurality of openings disposed substantially equidistantly in a substantially grid like pattern in a plurality of rows and columns, each one said one or more die support panels having a plurality of y-axis indicia, each one of said plurality of y-axis indicia being disposed substantially adjacently with a corresponding row of said openings, each one said one or more die support panels further having a plurality of x-axis indicia, each one of said plurality of x-axis indicia being disposed substantially adjacently with a corresponding column of said openings, wherein each pair of one of said x-axis indicia and one of said y-axis indicia reference and correspond to one of said plurality of openings;

b) providing one or more dies, each of said one or more dies comprising a top surface having a graphic design thereon and a recessed region surrounding said graphic design, each die further having one or more apertures disposed in said recessed region, each aperture being referenced and identified with a pair of one of said plurality of x-axis and one of said plurality of y-axis indicia disposed substantially adjacently thereto;

c) providing a plurality of positioning fasteners;

d) using the pairs of x-axis and y-axis indicia disposed next to each aperture of said dies to align said apertures above corresponding openings of said die support panel that correspond with said pairs of x-axis and y-axis indicia disposed next to said apertures;

e) selectively attaching said dies to said die support panel with said plurality of fasteners.

18. The method of claim 17 further comprising the steps (immediately after the providing dies step) of:

providing said one or more dies with one or more through-holes, each through-hole being referenced and identified with a pair of one of said plurality of x-axis and one of said plurality of y-axis indicia disposed substantially adjacently thereto;

providing one or more connectors;

using the pairs of x-axis and y-axis indicia disposed next to each through-hole of said dies to align said through-holes above corresponding openings of said die support panel that correspond with said pairs of x-axis and y-axis indicia disposed next to said through-holes;

temporarily and selectively pre-installing said dies to said die support panel with said one or more connectors.

19. The method of claim 18, further comprising the step of selectively attaching one or more adjusters to the die support panel in a position adjacent to a side of the die, wherein the one or more adjusters are configured to optionally contact the side of the die.

20. The method of claim 19, wherein the die further comprises a plurality of sides, wherein at least one of the adjusters is positioned adjacent to each of the plurality of sides of the die, and wherein each of the adjusters is configured to optionally contact at least one side of the die.

* * * * *